US009524680B2

(12) United States Patent
Lee et al.

(10) Patent No.: US 9,524,680 B2
(45) Date of Patent: Dec. 20, 2016

(54) SYSTEM AND METHOD OF BOOSTING LAMP LUMINANCE IN A LAPTOP COMPUTING DEVICE

(71) Applicant: Dell Products, LP, Round Rock, TX (US)

(72) Inventors: Jaeik Lee, Santa Clara, CA (US); James Alan Yasukawa, Austin, TX (US)

(73) Assignee: Dell Products, LP, Round Rock, TX (US)

( * ) Notice: Subject to any disclaimer, the term of this patent is extended or adjusted under 35 U.S.C. 154(b) by 0 days.

(21) Appl. No.: 13/674,607

(22) Filed: Nov. 12, 2012

(65) Prior Publication Data

US 2013/0063501 A1 Mar. 14, 2013

Related U.S. Application Data

(63) Continuation of application No. 11/762,106, filed on Jun. 13, 2007, now Pat. No. 8,330,703.

(51) Int. Cl.
*G09G 5/10* (2006.01)
*G09G 3/34* (2006.01)

(52) U.S. Cl.
CPC ..... *G09G 3/3406* (2013.01); *G09G 2320/048* (2013.01); *G09G 2330/021* (2013.01)

(58) Field of Classification Search
CPC ..... G09G 3/3406; G09G 2320/0626; G09G 2320/0646
USPC .... 345/30, 77, 102, 204, 211, 690; 315/149; 362/97.1, 97.2
See application file for complete search history.

(56) References Cited

U.S. PATENT DOCUMENTS

| | | | | |
|---|---|---|---|---|
| 5,786,801 | A | 7/1998 | Ichise | |
| 5,958,058 | A * | 9/1999 | Barrus | G06F 1/3203 713/310 |
| 6,157,143 | A | 12/2000 | Bigio et al. | |
| 6,294,883 | B1 | 9/2001 | Weindorf | |
| 6,307,332 | B1 * | 10/2001 | Noguchi et al. | 315/362 |
| 6,690,121 | B1 | 2/2004 | Weindorf | |
| 6,825,828 | B2 | 11/2004 | Burke et al. | |
| 6,874,892 | B1 | 4/2005 | McDaniel | |
| 6,894,441 | B2 | 5/2005 | Chang | |
| 6,988,807 | B2 | 1/2006 | Belliveau | |
| 7,030,569 | B2 | 4/2006 | Gray | |
| 7,391,172 | B2 | 6/2008 | Ferguson et al. | |
| 2003/0227435 | A1 | 12/2003 | Hsieh | |
| 2004/0207532 | A1 | 10/2004 | Smithson | |
| 2005/0017994 | A1 * | 1/2005 | Oh | 345/691 |
| 2005/0078128 | A1 * | 4/2005 | Ozeki | 345/690 |
| 2005/0088102 | A1 * | 4/2005 | Ferguson | H05B 41/3922 315/149 |
| 2005/0116780 | A1 | 6/2005 | Endo et al. | |
| 2006/0001662 | A1 * | 1/2006 | Kunita | 345/212 |
| 2006/0077214 | A1 | 4/2006 | Tsou et al. | |
| 2006/0092182 | A1 | 5/2006 | Diefenbaugh et al. | |
| 2006/0109234 | A1 | 5/2006 | Hong et al. | |

(Continued)

FOREIGN PATENT DOCUMENTS

JP 04-130491 A 5/1992

*Primary Examiner* — Amare Mengistu
*Assistant Examiner* — Stacy Khoo
(74) *Attorney, Agent, or Firm* — Larson Newman, LLP

(57) ABSTRACT

An information handling system is disclosed and includes a display, a lamp back lighting the display, and a lamp control system coupled to the lamp. The lamp control system is configured to boost a maximum luminance of the lamp as the lamp ages.

20 Claims, 6 Drawing Sheets

(56) References Cited

U.S. PATENT DOCUMENTS

| | | | |
|---|---|---|---|
| 2007/0018941 | A1 | 1/2007 | Moyer et al. |
| 2007/0159446 | A1 | 7/2007 | Taylor et al. |
| 2008/0309682 | A1 | 12/2008 | Lee et al. |

* cited by examiner

SYSTEM AND METHOD OF BOOSTING LAMP LUMINANCE IN A LAPTOP COMPUTING DEVICE

CROSS REFERENCE TO RELATED APPLICATIONS

This application is a continuation of U.S. patent application Ser. No. 11/762,106, entitled "System and Method of Boosting Lamp Luminance in a Laptop Computing Device," filed on Jun. 13, 2007, the disclosure of which is hereby expressly incorporated by reference in its entirety.

FIELD OF THE DISCLOSURE

The present disclosure relates generally to portable computing devices. More specifically, the present disclosure relates to controlling lamp luminance in a laptop computing device.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

A typical laptop computing device can include a liquid crystal display (LCD) that is backlit by a cold cathode fluorescent lamp (CCFL). A CCFL can have a limited lifetime of approximately fifteen thousand hours (15,000 hrs). This time is based on the time that it takes the brightness, or luminance, of the CCFL to drop from an initial value to fifty percent (50%) of that initial value. The life of the CCFL can be a major factor in the number of laptop computing devices returned to the manufacturer to be replaced under warranty. In fact, approximately thirty-three percent (33%) of returned laptop computing devices are returned due to a dim CCFL.

The brightness, or luminance, of the CCFL is directly proportional to the lamp current, i.e., as the lamp current increases, the brightness increases. However, the life of the CCFL is indirectly proportional to the lamp current, as the lamp current increases, the life of the CCFL decreases. A laptop computing device is typically manufactured with a maximum brightness that is based on a factory set lamp current that is optimized between the power consumption and the brightness target. This maximum brightness is not adjustable by the user.

Accordingly, there is a need for an improved laptop computing device with a system and method of controlling maximum lamp luminance.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

An information handling system is disclosed and includes a display, a lamp back lighting the display, and a lamp control system coupled to the lamp. The lamp control system is configured to boost a maximum luminance of the lamp as the lamp ages.

In another embodiment, a method of increasing a maximum luminance of a lamp within an information handling system is disclosed. The method can include receiving a user request to increase a maximum luminance and based on the user request and a temperature of the lamp, selectively increasing a lamp current in order to increase a maximum luminance of the lamp.

In yet another embodiment, a method of increasing luminance of a lamp within an information handling system is disclosed. The method comprises monitoring a luminance, L, of the lamp starting at an initial luminance, $L_I$, and increasing L to a first boosted luminance, $L_{B1}$, when L is equal to a predetermined first luminance boost trigger, $L_{BT1}$.

As indicated above, the following description in combination with the Figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. For example, much of the following focuses on dynamically changing file types within a distributed file systems. While the teachings may certainly be utilized in this application, the teachings may also be utilized in other applications and with several different types of architectures such as distributed computing architectures, client/server architectures, or middleware server architectures.

Figure 1:
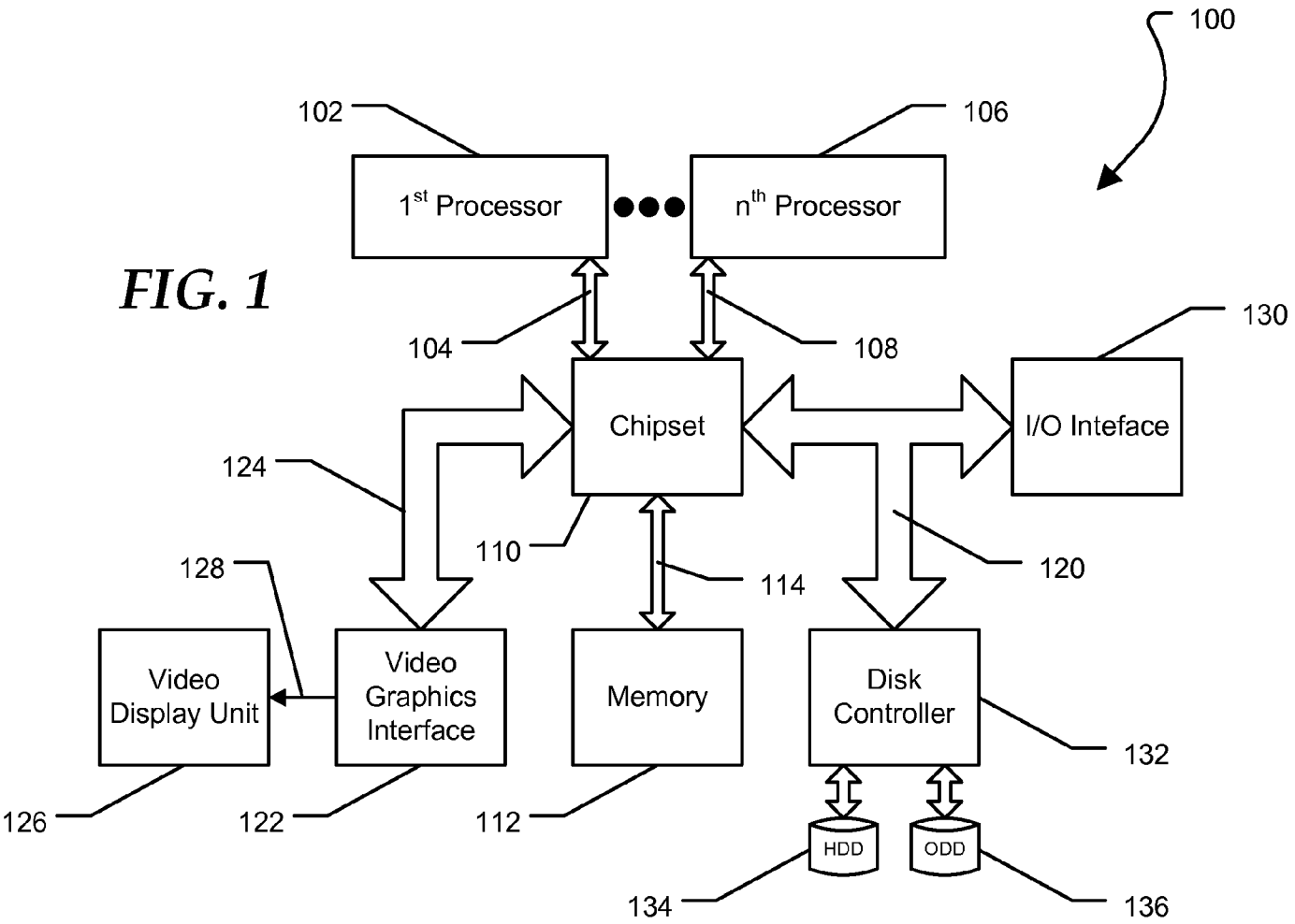
FIG. 1 is a block diagram of an information handling system.

FIG. 1 illustrates a block diagram of an exemplary embodiment of an information handling system, generally designated at 100. In one form, the information handling system 100 can be a computer system such as a server. As shown in FIG. 1, the information handling system 100 can include a first physical processor 102 coupled to a first host bus 104 and can further include additional processors generally designated as $n^{th}$ physical processor 106 coupled to a second host bus 108. The first physical processor 102 can be coupled to a chipset 110 via the first host bus 104. Further, the $n^{th}$ physical processor 106 can be coupled to the chipset 110 via the second host bus 108. The chipset 110 can support multiple processors and can allow for simultaneous processing of multiple processors and support the exchange of information within information handling system 100 during multiple processing operations.

According to one aspect, the chipset 110 can be referred to as a memory hub or a memory controller. For example, the chipset 110 can include a dedicated bus to transfer data between first physical processor 102 and the $n^{th}$ physical processor 106. For example, the chipset 110 including a chipset that can include a memory controller hub and an input/output (I/O) controller hub. As a memory controller hub, the chipset 110 can function to access the first physical processor 102 using first bus 104 and the $n^{th}$ physical processor 106 using the second host bus 108. The chipset 110 can also provide a memory interface for accessing memory 112 using a memory bus 114. In a particular embodiment, the buses 104, 108, and 114 can be individual buses or part of the same bus. The chipset 110 can also provide bus control and can handle transfers between the buses 104, 108, and 114.

According to another aspect, the chipset 110 can include an application specific chipset that provides connectivity to various buses, and integrates other system functions. For example, the chipset 110 can be provided using an Intel® Hub Architecture (IHA) chipset that can also include two parts, a Graphics and AGP Memory Controller Hub (GMCH) and an I/O Controller Hub (ICH). For example, an Intel 820E, an 815E chipset, an Intel 975X chipset, an Intel G965 chipset, available from the Intel Corporation of Santa Clara, Calif., or any combination thereof, can provide at least a portion of the chipset 110. The chipset 110 can also be packaged as an application specific integrated circuit (ASIC).

In one form, the chipset 110 can be coupled to a video graphics interface 122 using a third bus 124. In one form, the video graphics interface 122 can be a Peripheral Component Interconnect (PCI) Express interface operable to provide content to display within a video display unit 126. Other graphics interfaces may also be used. The video graphics interface 122 can provide a video display output 128 to the video display unit 126. The video display unit 126 can include one or more types of video displays such as a flat panel display (FPD), cathode ray tube display (CRT) or other type of display device.

The information handling system 100 can also include an I/O interface 130 that can be connected via an I/O bus 120 to the chipset 110. The I/O interface 130 and I/O bus 120 can include industry standard buses or proprietary buses and respective interfaces or controllers. For example, the I/O bus 120 can also include a PCI bus or a high speed PCI-Express bus. In one embodiment, a PCI bus can be operated at approximately 66 MHz and a PCI-Express bus can be operated at more than one (1) speed (e.g. 2.5 GHz and 5 GHz). PCI buses and PCI-Express buses can be provided to comply with industry standards for connecting and communicating between various PCI-enabled hardware devices. Other buses can also be provided in association with, or independent of, the I/O bus 120 including, but not limited to, industry standard buses or proprietary buses, such as Industry Standard Architecture (ISA), Small Computer Serial Interface (SCSI), Inter-Integrated Circuit ($I^2C$), System Packet Interface (SPI), or Universal Serial buses (USBs).

In an alternate embodiment, the chipset 110 can be a chipset employing a Northbridge/Southbridge chipset configuration (not illustrated). For example, a Northbridge portion of the chipset 110 can communicate with the first physical processor 102 and can control interaction with the memory 112, the I/O bus 120 that can be operable as a PCI bus, and activities for the video graphics interface 122. The Northbridge portion can also communicate with the first physical processor 102 using first bus 104 and the second bus 108 coupled to the $n^{th}$ physical processor 106. The chipset 110 can also include a Southbridge portion (not illustrated) of the chipset 110 and can handle I/O functions of the chipset 110. The Southbridge portion can manage the basic forms of I/O such as Universal Serial Bus (USB), serial I/O, audio outputs, Integrated Drive Electronics (IDE), and ISA I/O for the information handling system 100.

The information handling system 100 can further include a disk controller 132 coupled to the I/O bus 120, and connected to an I/O interface 130 and one or more internal disk drives such as a hard disk drive (HDD) 134 and an optical disk drive (ODD) 136 such as a Read/Write Compact Disk (R/W CD), a Read/Write Digital Video Disk (R/W DVD), a Read/Write mini-Digital Video Disk (R/W mini-DVD), or other type of optical disk drive.

Figure 2:
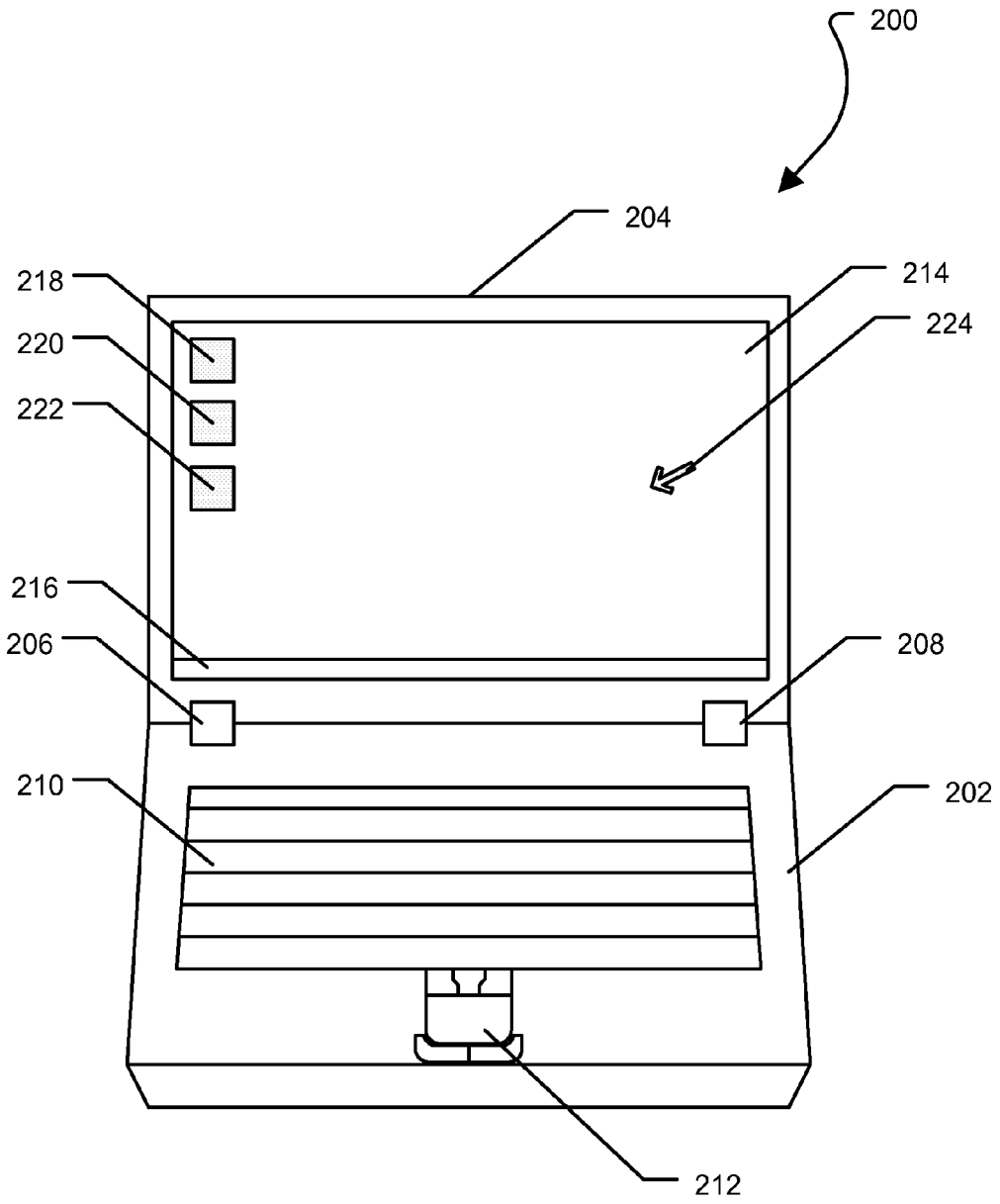
FIG. 2 is a front view of a laptop computing device.

In a particular embodiment, the information handling system 100 can include a laptop computing device. FIG. 2 shows an embodiment of a laptop computing device that is designated 200. As illustrated in FIG. 2, the laptop computing device 200 includes a base 202 and a lid 204 that is coupled to the base by a first hinge 206 and a second hinge 208. In a particular embodiment, a keyboard 210 is incorporated into the base 202 of the laptop computing device 200. Further, a mouse 212 is incorporated into the base 202 of the laptop computing device 200. In an illustrative embodiment, the mouse 212 is a touch pad mouse.

As shown in FIG. 2, a display 214 is incorporated into the lid 204 of the laptop computing device 200. In a particular embodiment, the display 214 can be a liquid crystal display (LCD), e.g., a thin film transistor (TFT) LCD. Alternatively, the display 214 can be a plasma display or an organic light emitting diode (OLED) display. In a particular embodiment, the display 214 can be backlit by a cold cathode fluorescent lamp (CCFL). The lamp current of the CCFL can be controlled, as described herein, in order to substantially maximize brightness of the CCFL or maximize the life of the CCFL.

In a particular embodiment, a task bar 216 and a plurality of desktop icons 218, 220, 222 can be presented to a user of the laptop computing device 200 via the display 214. Further, a cursor 224 can be presented to the user via the display 214. In a particular embodiment, the task bar 216, the plurality of desktop icons 218, 220, 222, and the cursor 224 are part of a desktop that can be selectively presented to a user. Further, in a particular embodiment, a user can control the curser 224 with the mouse 212 and as such, a user can interact with one or more programs executable by the laptop computing device 200 via the display 214 and the mouse 212.

For example, a lamp control panel can be presented to the user via the display 214. The user can use the lamp control panel to change a maximum brightness of the CCFL. The maximum brightness of the CCFL is the maximum brightness that can be achieved by the CCFL during operation of the laptop computing device in which the CCFL is installed. The maximum brightness of the CCFL is based on the life of the CCFL and is based on the lamp current supplied to the CCFL. For a particular lamp current, the maximum brightness of the CCFL will deteriorate as the CCFL ages. In a particular embodiment, the user may decide to increase the maximum brightness of the CCFL for a particular application, e.g., a video game, a photography program, a computer aided drafting (CAD) program, or some other program in which the brightness of the CCFL increases the user experience with the program.

In a particular embodiment, the user may decide to increase the maximum brightness of the CCFL when the laptop computing device is operating on alternating current (AC) and decrease the brightness of the CCFL when the laptop computing device is operating on direct current (DC). This may save power and increase a battery operating time of the laptop computing device. Also, after the laptop computing device is out of warranty, the user may decide to increase the then-current maximum brightness of the CCFL if the user has noticed that the CCFL has begun to dim due to aging of the CCFL. Alternatively, the maximum brightness can automatically be increased when the luminance of the CCFL reaches a predetermined minimum value due to aging of the CCFL. The lamp control panel can also indicate to the user a decrease in lamp life due to an increase in brightness of the CCFL or an increase in lamp life due to a decrease in brightness of the CCFL.

Figure 3:
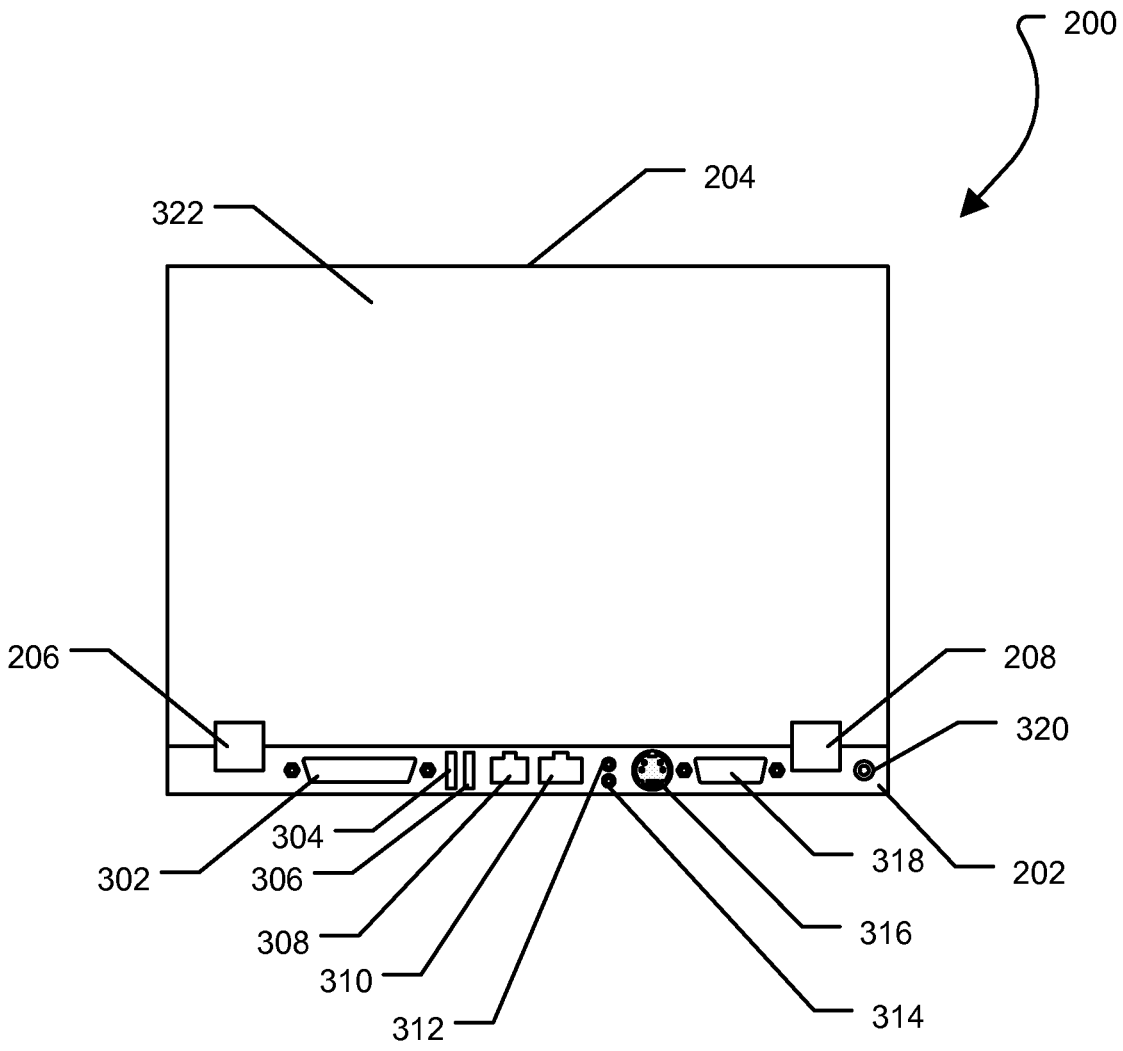
FIG. 3 is a rear view of the laptop computing device illustrated in FIG. 2.

Referring to FIG. 3, the back of a laptop computing device, such as the laptop computing device 200, is illustrated. FIG. 3 illustrates the back of the base 202 and the back of the lid 204. As shown, the laptop computing device 200 can include a plurality of device connections that are coupled to a processor within the laptop computing device 200. In an illustrative embodiment, the laptop computing device 200 can include a printer connection 302, e.g., an IEEE-1284 connection. Additionally, the laptop computing device 200 can include a first universal serial bus (USB) connection 304 and a second USB connection 306. In a particular embodiment, two USB enabled devices can be coupled to the laptop computing device 200 via the USB connections 304, 306. FIG. 3 further illustrates that the laptop computing device 200 can include a modem connection 308, e.g., an RJ-11 connection. Also, the laptop computing device 200 can include an Ethernet connection 310, e.g., an RJ-45 connection.

As shown in FIG. 3, the laptop computing device 200 can further include a headphone connection 312 and a microphone connection 314. Additionally, the laptop computing device 200 can include an S-video connection 316 and an external monitor connection 318. Also, the laptop computing device 200 can include an AC adapter connection 320. In an exemplary, non-limiting embodiment, as depicted in FIG. 3, the various connections 302, 304, 306, 308, 310, 312, 314, 316, 318, 320 can be incorporated into the base 202 of the laptop computing device 200. Further, in an exemplary, non-limiting embodiment, the laptop computing device 200 can include one or more Personal Computer Memory Card International Association (PCMCIA) connections, a compact disk (CD) drive, a digital video disk (DVD) drive, and a battery.

Figure 4:
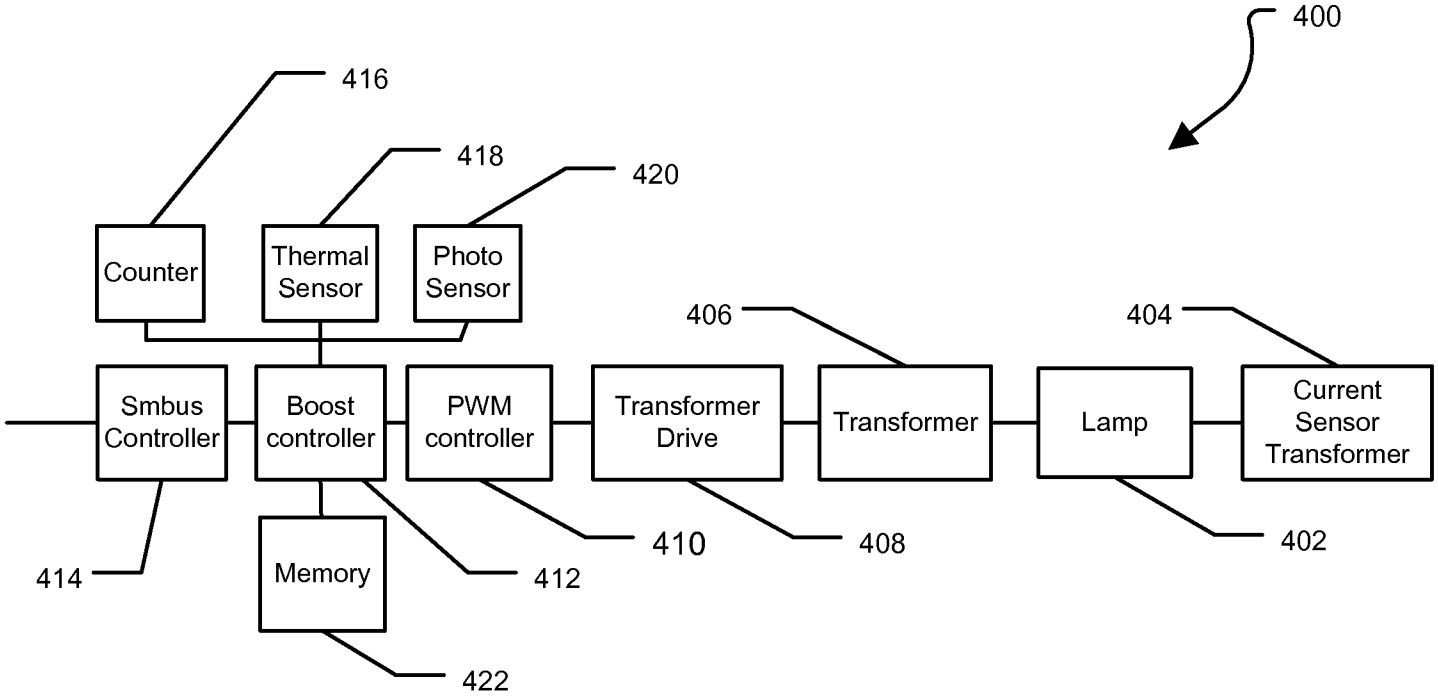
FIG. 4 is a general diagram illustrating a lamp control system.

FIG. 4 shows a lamp control system, generally designated 400, that can be installed within the laptop computing device 200. In a particular embodiment, the lamp control system 400 can be a cold cathode fluorescent lamp (CCFL) control system. As shown, the lamp control system 400 can include a lamp 402, e.g., a CCFL. A current sensor transformer 404 can be coupled to the lamp 402. Further, a transformer 406 can be coupled to the lamp 402. A transformer drive 408 can be coupled to the transformer 406 and a (pulse width modulator) PWM controller 410 can be connected to the transformer drive 408. Also, a boost controller 412 can be coupled to the PWM controller 410.

As shown in FIG. 4, a SmBus controller 414 can be coupled to the boost controller 412. Further, a counter 416, a thermal sensor 418, and a photo sensor 420 can be coupled to the boost controller 412. Also, a memory 422 can be coupled to the boost controller 412. As described below, the lamp control system 400 can be used to control the luminance, or brightness, of the lamp.

For example, the boost controller 412 can use the counter 415, the thermal sensor 418, and a photo sensor 420 to monitor the lamp and control the luminance of the lamp. For example, if the photo sensor 420 senses that the lamp has dimmed, a message may be sent to a user asking if the user would like to increase the brightness of the lamp. If so, the lamp current can be adjusted to increase the brightness. Further, if the thermal sensor 418 senses that the lamp is approaching a critical temperature, the user can be sent a warning indicating such a condition. Further, the user can be warned that the brightness of the lamp will be decreased to allow the lamp to cool sufficiently.

If the user wishes to have increased brightness, while decreasing lamp life, the user can use the lamp control system 400 to increase the lamp current. Also, if the user wishes to increase the lamp life, while decreasing luminance, the user can use the lamp control system 400 to decrease the lamp current. Additionally, as the lamp ages, the lamp current can be increased to increase the luminance of the lamp. This can be automatic or based on input received from the user. For example, as the lamp ages, the user may notice that the luminance of the lamp has decreased. In a particular embodiment, the user can access a diagnostic tool associated with the lamp, e.g., a lamp control panel. From the lamp control panel, the user can increase the lamp current in order to increase the luminance of the lamp.

Figure 5:
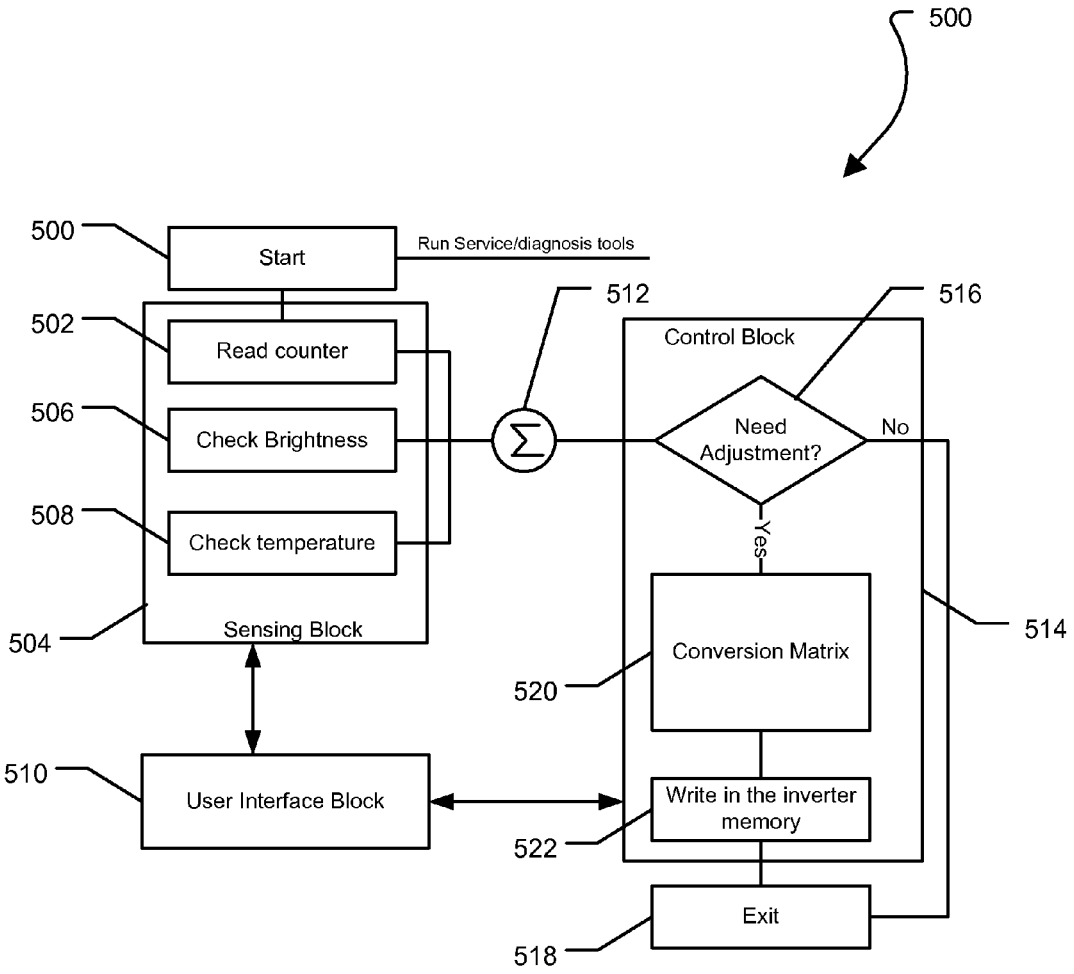
FIG. 5 is a flow chart illustrating a method of controlling a lamp within a laptop computing device.

Referring to FIG. 5, a method of controlling lamp luminance is shown and commences at block 500, when a user runs a service module or accesses a diagnostic tool. At block 502, a sensing block 504 can read a counter. The counter can indicate the number of times the lamp has been powered on and off In a particular embodiment, the more the lamp is powered on, i.e., fired, the greater the decrease in the life of the lamp. At block 506, the sensing block 504 can check the brightness of the lamp. Also, at block 508, the sensing block 504 can check the temperature of the lamp. In a particular embodiment, the sensing block can be placed near the lamp area to maximize the accuracy of the sensing block, e.g., the accuracy of a photo sensor within a sensing block or a thermal sensor within the sensing block.

The sensing block 504 can also receive user input from a user interface block 510. The user input can include a specific request by the user to increase the brightness, or luminance, of the lamp. The request can be a request to increase the luminance by a percentage from the current value, e.g., one percent (1%), two percent (2%), three percent (3%), four percent (4%), five percent (5%), six percent (6%), seven percent (7%), eight percent (8%), nine percent (9%), ten percent (10%), etc. The user input can also include a specific request by the user to decrease the brightness of the lamp. The request can be a request to decrease the luminance by a percentage from the current value, e.g., one percent (1%), two percent (2%), three percent (3%), four percent (4%), five percent (5%), six percent (6%), seven percent (7%), eight percent (8%), nine percent (9%), ten percent (10%), etc. The user input can also include a request by the user to increase the life of the lamp. The request can be a request to increase the life of the lamp by a percentage value over the predetermined life of the lamp, one percent (1%), two percent (2%), three percent (3%), four percent (4%), five percent (5%), six percent (6%), seven percent (7%), eight percent (8%), nine percent (9%), ten percent (10%), etc.

The sensing block 504 can transmit one or more signals to a summation unit 512. The summation unit 512 can take the outputs from the sensing block and transmit a summed signal to a control block 514. Based on the signal from the summation unit 512, the control block 514 can determine, at decision step 516, whether the luminance of the lamp needs adjustment. The decision can be at least partially based on the user input, the counter value, the temperature of the lamp, the luminance of the lamp, or a combination thereof. If the luminance does not need adjustment, the method can move to block 518 and the diagnostic tool can be exited and the method can end.

Returning to decision step 516, if the luminance of the lamp needs adjustment, based on the signal received from the sensing block 504, via the summation unit 512, the method can move to block 520. At block 520, the control block 514 can access a conversion matrix. The conversion matrix can be a look-up table that can include one or more preset registers that can be used to convert the input from the sensing block in order to adjust the luminance of the lamp. For example, a five percent (5%) increase in lamp luminance may require a one-quarter milliAmp (0.25 mA) increase in lamp current. Proceeding to block 522, the new setting for the lamp luminance can be written in an inverter memory. Thereafter, the diagnostic tool can be exited at block 518 and the method can end.

Figure 6:
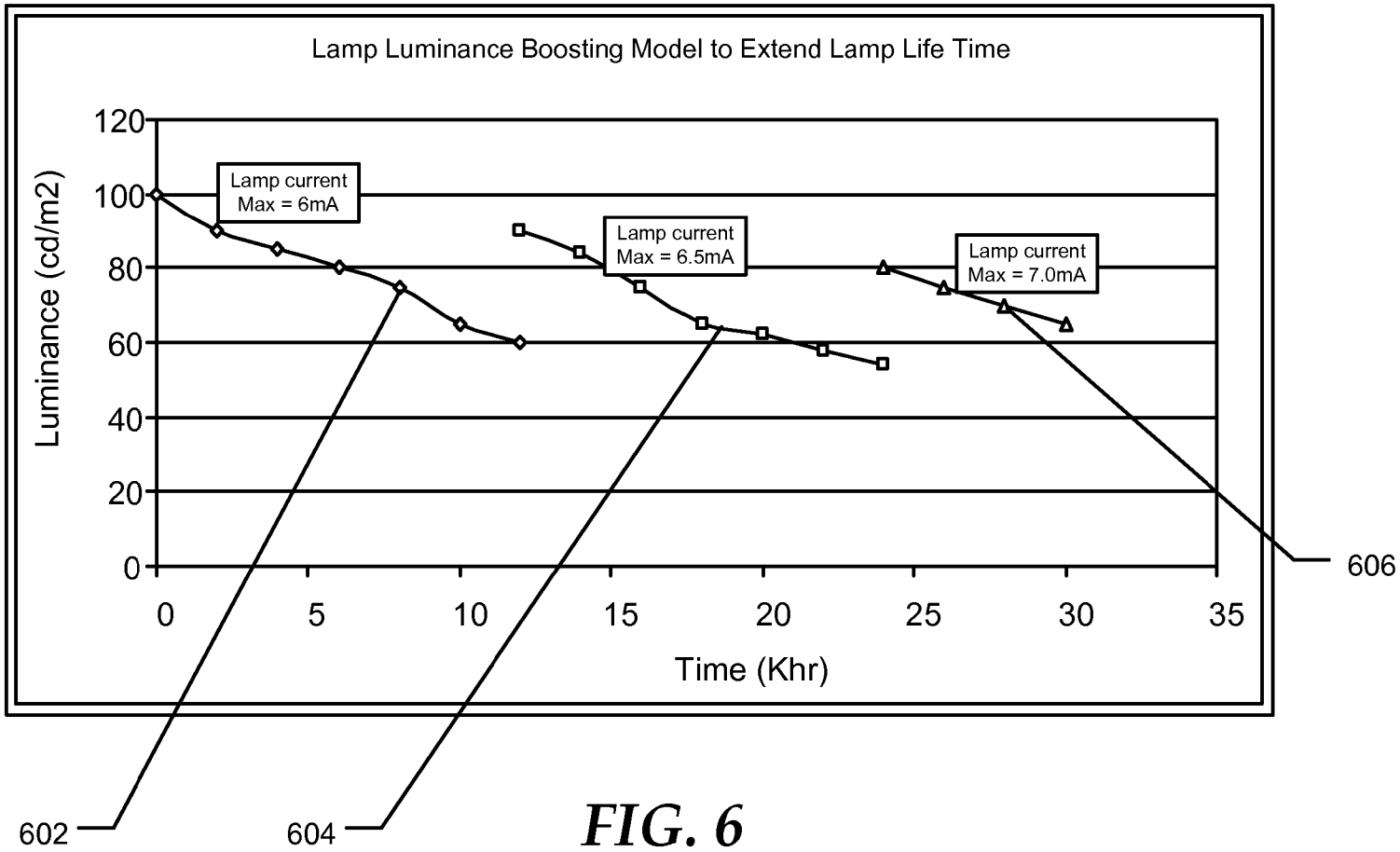
FIG. 6 is a graph indicating lamp luminance plotted versus lamp life for three different lamp currents.

Referring to FIG. 6 a plot of luminance versus kilohours is shown. A first plot line 602 indicates that for a lamp operating at a lamp current of approximately six milliAmps (6 mA), luminance can decrease from an initial luminance, $L_I$, approximately one hundred candela per square meters (100 cd/m$^2$) to a predetermined first boost trigger luminance, $L_{BT1}$, that is equal to $0.6*L_I$, e.g., approximately sixty candela per square meters (60 cd/m$^2$) at approximately twelve thousand hours (12 Kh). A second plot line 604 indicates that by boosting the lamp current one-half milliAmp (0.5 mA) to six and one-half milliAmps (6.5 mA), the luminance can be boosted to a first boosted luminance, $L_{B1}$, that is $0.9*L_I$, e.g., approximately ninety candela per square meters (90 cd/m$^2$). Thereafter, the luminance can steadily decrease to a second boost trigger luminance, $L_{BT2}$, that is equal to $0.5*L_I$, e.g., approximately fifty candela per square meters (50 cd/m$^2$) over the next twelve thousand hours (12 Kh) until approximately twenty four thousand hours (24 Kh).

A third plot line 606 indicates that at twenty four thousand hours (24 Kh), the luminance can be boosted, once again, to a second boosted luminance, $L_{B2}$, that is equal to $0.8*L_I$, e.g., approximately eighty candela per square meters 80 cd/m$^2$) by increasing the lamp current one-half milliAmp (0.5 mA) to seven milliAmps (7.0 mA). The luminance can then decrease to approximately sixty-five candela per square meters (65 cd/m$^2$) over the next six thousand hours (6 Kh) until approximately thirty thousand hours (30 Kh). Thereafter, thermal limits may prevent the lamp current from being increased to an even higher value.

In a particular embodiment, the lamp control system described herein can monitor the luminance, L, of the lamp. As the L decreases from $L_I$, the system can determine when L is equal $L_{BT1}$. At approximately $L_{BT1}$, the system can automatically boost L to $L_{B1}$. The system can automatically boost L to $L_{B1}$ by boosting the lamp current, $C_L$, from an initial lamp current, $C_{LI}$, to a first boosted lamp current, $C_{BL1}$. Alternatively, a warning can be sent to the user with an indication that the luminance can be boosted by increasing the lamp current and the user can be queried on whether to increase the lamp current.

Thereafter, the lamp control system can continue to monitor L. At approximately $L_{BT2}$, the system can automatically boost L to $L_{B2}$. The system can automatically boost L to $L_{B1}$ by boosting $C_L$ from $C_{LBL1}$ to a second boosted lamp current, $C_{BL2}$. Alternatively, a warning can be sent to the user with an indication that the luminance can be boosted by increasing the lamp current and the user can be queried on whether to increase the lamp current.

With the configuration of structure described herein, the system and method described herein can be used to control the luminance of a cold cathode fluorescent lamp (CCFL). As the lamp ages, the lamp current can be increased to increase the luminance of the lamp. Additionally, if the user wishes to have increased brightness, while decreasing lamp life, the user can use the system to increase the lamp current. Also, if the user wishes to increase the lamp life, while decreasing luminance, the user can use the lamp control system to decrease the lamp current. As the CCFL ages and dims, the user can access a control panel in order to increase the luminance of the CCFL. Alternatively, the system can automatically boost the lamp current in order to boost the luminance of the CCFL. The system and method can be used in conjunction with a laptop computing device, a computer monitor, a television, or another similar device.

The above-disclosed subject matter is to be considered illustrative, and not restrictive, and the appended claims are intended to cover all such modifications, enhancements, and other embodiments that fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. A method of varying a luminance of a lamp within an information handling system, the method comprising:

sending a message to a user asking if the user would like to change the luminance of the lamp;

receiving a user request to increase a life of the lamp by a particular percentage over a predetermined life of the lamp in response to the message;

based on the user request, a temperature of the lamp, and a counter value indicating the number of times the lamp has been powered on and off, selectively decreasing a lamp current in order to change the luminance of the lamp, wherein the decrease in the lamp current increases the life of the lamp;

determining a projected increase of the life of the lamp based on the decreased lamp current; and displaying the projected increase of the lamp life to a user.

2. The method of claim 1, wherein the luminance of the lamp is increased for a particular application each time the application executes within the information handling system.

3. The method of claim 2, wherein the application is a video game, a photography program, or a computer aided drafting program.

4. The method of claim 1, further comprising:

decreasing the lamp current to a determined lamp current.

5. The method of claim 4, further comprising:

decreasing the lamp current to decrease the luminance of the lamp, wherein a maximum luminance of the lamp is decreased when the information handling system is switched from alternating current to direct current.

6. The method of claim 5, further comprising:

determining an increase of a lamp life based on the decrease in the luminance; and displaying the increasing in lamp life to a user.

7. The method of claim 1, wherein the information handling system comprises a laptop computing device.

8. An information handling system comprising:

a display;

a lamp back lighting the display; and a lamp control system coupled to the lamp, the lamp control system to receive a user request to increase a life of the lamp by a particular percentage over a predetermined life of the lamp, and based on the user request, a temperature of the lamp, and a counter value indicating the number of times the lamp has been powered on and off, to selectively decrease a lamp current in order to change a luminance of the lamp, wherein the decrease in the lamp current increases the life of the lamp.

9. The information handling system of claim 8, wherein the lamp control system is further configured to determine an increase of a lamp life based on a decrease in the luminance, and to display the increase in lamp life to a user.

10. The information handling system of claim 8, wherein the luminance of the lamp is increased for a particular application each time the application executes within the information handling system.

11. The information handling system of claim 10, wherein the application is a video game, a photography program, or a computer aided drafting program.

12. The information handling system of claim 8, wherein the lamp control system is further configured to receive a user request to decrease the luminance, and to decrease lamp current in order to decrease the luminance of the lamp.

13. The information handling system of claim 12, wherein the luminance of the lamp is decreased when the information handling system is switched from alternating current to direct current.

14. The information handling system of claim 12, wherein the lamp control system is further configured to determine an increase of a lamp life based on the decrease in the luminance, and to display the increase in lamp life to a user.

15. A method of varying a luminance of a lamp within an information handling system, the method comprising:

sending a message to a user asking if the user would like to change the luminance of the lamp;

receiving a user request to increase a life of the lamp by a particular percentage over a predetermined life of the lamp in response to the message; and based on the user request, a temperature of the lamp, and a counter value indicating the number of times the lamp has been powered on and off, selectively decreasing a lamp current in order to change the luminance of the lamp, wherein the decrease in the lamp current increases the life of the lamp.

16. The method of claim 15, further comprising: displaying an increase in lamp life to the user.

17. The method of claim 15, wherein the luminance of the lamp is increased for a particular application each time the application executes within the information handling system.

18. The method of claim 17, wherein the application is a video game, a photography program, or a computer aided drafting program.

19. The method of claim 15, wherein the information handling system comprises a laptop computing device.

20. The method of claim 15, further comprising: decreasing the lamp current to a determined lamp current.

* * * * *